US009133642B2

(12) United States Patent
Giacomoni et al.

(10) Patent No.: US 9,133,642 B2
(45) Date of Patent: Sep. 15, 2015

(54) PLATFORM ASSEMBLY MOBILE WITHIN A CYLINDRICAL STRUCTURE

(71) Applicant: AEROGROUPE, Paris (FR)

(72) Inventors: Jérôme Giacomoni, Saint-Cloud (FR); Matthieu Gobbi, Paris (FR)

(73) Assignee: AEROGROUPE, Paris (FR)

( * ) Notice: Subject to any disclaimer, the term of this patent is extended or adjusted under 35 U.S.C. 154(b) by 0 days.

(21) Appl. No.: 14/135,767

(22) Filed: Dec. 20, 2013

(65) Prior Publication Data

US 2014/0174854 A1 Jun. 26, 2014

(30) Foreign Application Priority Data

Dec. 20, 2012 (FR) ..... 12 62501

(51) Int. Cl.

| | |
|---|---|
| ***A63G 31/02*** | (2006.01) |
| ***E04H 12/18*** | (2006.01) |
| ***A63G 1/44*** | (2006.01) |
| ***A63G 31/10*** | (2006.01) |

(52) U.S. Cl.

CPC *E04H 12/18* (2013.01); *A63G 1/44* (2013.01); *A63G 31/10* (2013.01)

(58) Field of Classification Search

CPC ..... A63G 31/00; A63G 31/02; A63G 31/16; G09B 9/00; G09B 9/12

USPC ..... 472/2, 50, 130, 131, 136

See application file for complete search history.

(56) References Cited

U.S. PATENT DOCUMENTS

| | | | | |
|---|---|---|---|---|
| 989,821 | A | 4/1911 | Stoetzel | |
| 1,034,864 | A | 8/1912 | Best | |
| 1,207,914 | A | 12/1916 | Hazen | |
| 5,421,783 | A * | 6/1995 | Kockelman et al. | 472/135 |
| 5,649,866 | A * | 7/1997 | Balwanz | 472/118 |
| 7,922,594 | B2 * | 4/2011 | Verl et al. | 472/131 |
| 7,926,787 | B2 | 4/2011 | Wieland | |

FOREIGN PATENT DOCUMENTS

| | | | |
|---|---|---|---|
| CN | 201768352 | U | 3/2011 |
| FR | 2882996 | A1 | 9/2006 |
| JP | S48-104336 | A | 12/1973 |
| WO | 2006/095082 | A1 | 9/2006 |

OTHER PUBLICATIONS

European Search Report issued in European Patent Application No. 13198598.8, mailing date Mar. 13, 2014 (8 pages).

* cited by examiner

*Primary Examiner* — Kien Nguyen
(74) *Attorney, Agent, or Firm* — Osha Liang LLP

(57) ABSTRACT

The invention concerns an assembly comprising a platform assembly (100) intended to receive passengers and a cylindrical structure (200), the platform assembly being mobile within the cylindrical structure. The assembly has very high stability as well as offering the passengers strong sensations of being raised up in the open air, with minimum obstruction of a panoramic view.

7 Claims, 4 Drawing Sheets

PLATFORM ASSEMBLY MOBILE WITHIN A CYLINDRICAL STRUCTURE

The invention concerns a platform assembly mobile within a cylindrical structure. A platform assembly of this kind is designed to receive passengers and is intended to be installed in theme parks and tourist sites, for example.

DESCRIPTION OF THE PRIOR ART

Various systems are known for enabling passengers to be lifted up and obtain the benefit of an unrestricted view of a landscape of interest or simply for their amusement.

For example, U.S. Pat. No. 7,926,787 describes a platform assembly designed to receive passengers and a mechanism for raising the platform assembly by means of inflatable pockets enabling the platform assembly to be raised and lowered.

Other systems are known in which the platform assembly intended to receive the passengers is suspended. These systems are more impressive for the passengers because they have the sensation that there is nothing under their feet. For example, a platform assembly suspended by a cable from the boom of a crane is used to receive guests and to organize a dinner or an event high up and combining dining and amusement (see www.dinnerinthesky.com). Published patent FR 2882996 in the name of the applicant describes a system with a basket suspended from a balloon that is its mobile within a tower, the basket being able to receive passengers. The cited suspended systems suffer from the problem of balancing the platform assembly or the basket once the passengers have boarded, however, and the drawback of having elements above the passengers.

In an even more classic way, lifts enable passengers to be carried in a cabin. The cabin is either suspended from a central fixed point or pushed by a system situated at the bottom, for example a ram, thus reducing the sensation experienced by the passengers. For obvious safety reasons, the proximity of the supporting structure guiding the cabin moreover obliges the passengers to be safely inside a closed cabin which may at best be glazed.

Finally, other elevating platform assembly systems consist of a fixed pylon (tower) and a lateral or annular basket surrounding the pylon and able to move in translation along the pylon. In these cases, the bulk of the tower and its proximity to the basket rule out a 360° view. The height to which such a platform assembly can be raised is moreover limited by stability constraints.

U.S. Pat. No. 1,034,864 describes a device consisting of a tower comprising uprights, reinforcements and platforms. A spiral track is mounted between the uprights. A vertical shaft comprising channels is mounted at the centre of the tower. A structure comprising passenger-carrying cars is mounted around the vertical shaft, said structure being connected to the channels and disposed on wheels on the spiral track.

The present invention provides an ascending platform assembly intended to receive passengers that enables a very high level of stability at the same time as offering the passengers a strong sensation of being lifted up in the open air, with minimum obstruction of a panoramic view.

SUMMARY OF THE INVENTION

In a first aspect, the invention concerns an assembly comprising a platform assembly intended to receive passengers, a cylindrical structure, the platform assembly being mobile within the cylindrical structure. In a preferred embodiment, the cylindrical structure comprises at least three vertical posts. The three posts may be connected by braces. The cylindrical structure has a circular base, for example, with braces curved in a helix, or more simply cylindrical with a triangular base.

Further, the assembly includes at least three carriages fastened to the platform assembly and adapted to be attached to drive cables accommodated in guide rails of at least three of the posts of the cylindrical structure.

With nothing above or below them, the passengers in the attraction experience strong sensations and have the benefit of an unrestricted view. The stability of such a structure enables lifting to several tens of meters, or even around 100 meters. It is therefore possible to organize events of the dinner-in-the-sky, cocktail party, etc. type.

In one variant, the assembly comprises, for each carriage, a fall-preventing mechanism. For example, the fall-preventing mechanism comprises a finger fastened to the carriage and a rack fixed to the guide rail, the finger being designed to abut against a tooth of the rack in the event of loss of tension in the cable.

In one variant, the platform assembly comprises a central platform and beams extending from the central platform, the carriages being fixed to the ends of the beams.

In one variant, the assembly includes a motor associated with each drive cable to drive the cable in one direction or the other.

In one variant, the assembly comprises a control unit adapted to synchronize the cable drive motors.

In one variant, the assembly comprises a cover for protecting passengers against inclement weather fixed above the platform assembly.

The cover is inflatable and of ellipsoidal shape, for example.

BRIEF DESCRIPTION OF THE FIGURES

Other aspects and advantages of the invention will become apparent on reading the following description, illustrated by the following figures.

DETAILED DESCRIPTION OF THE INVENTION

Figure 1A:
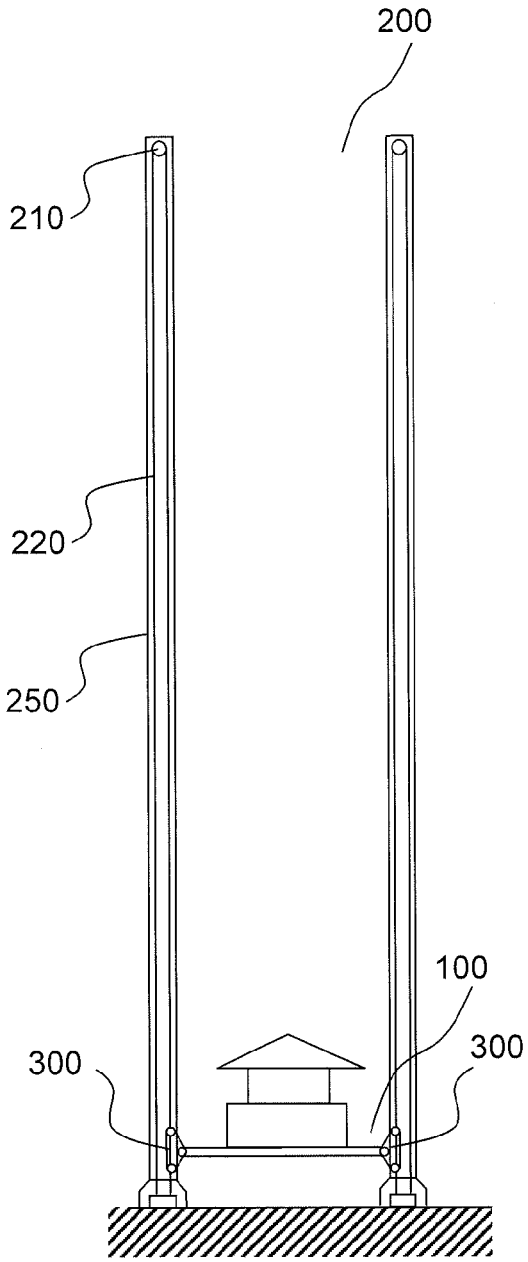
FIGS. 1A and 1B are diagrams showing a platform assembly in accordance with one embodiment of the invention that is mobile within a cylindrical structure.
Figure 1B:
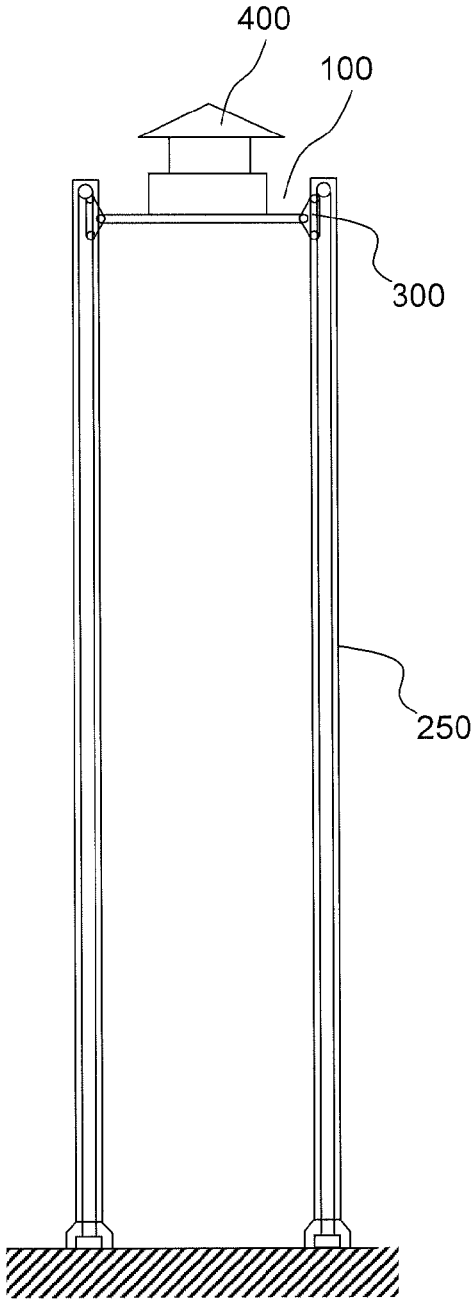
Figure 2:
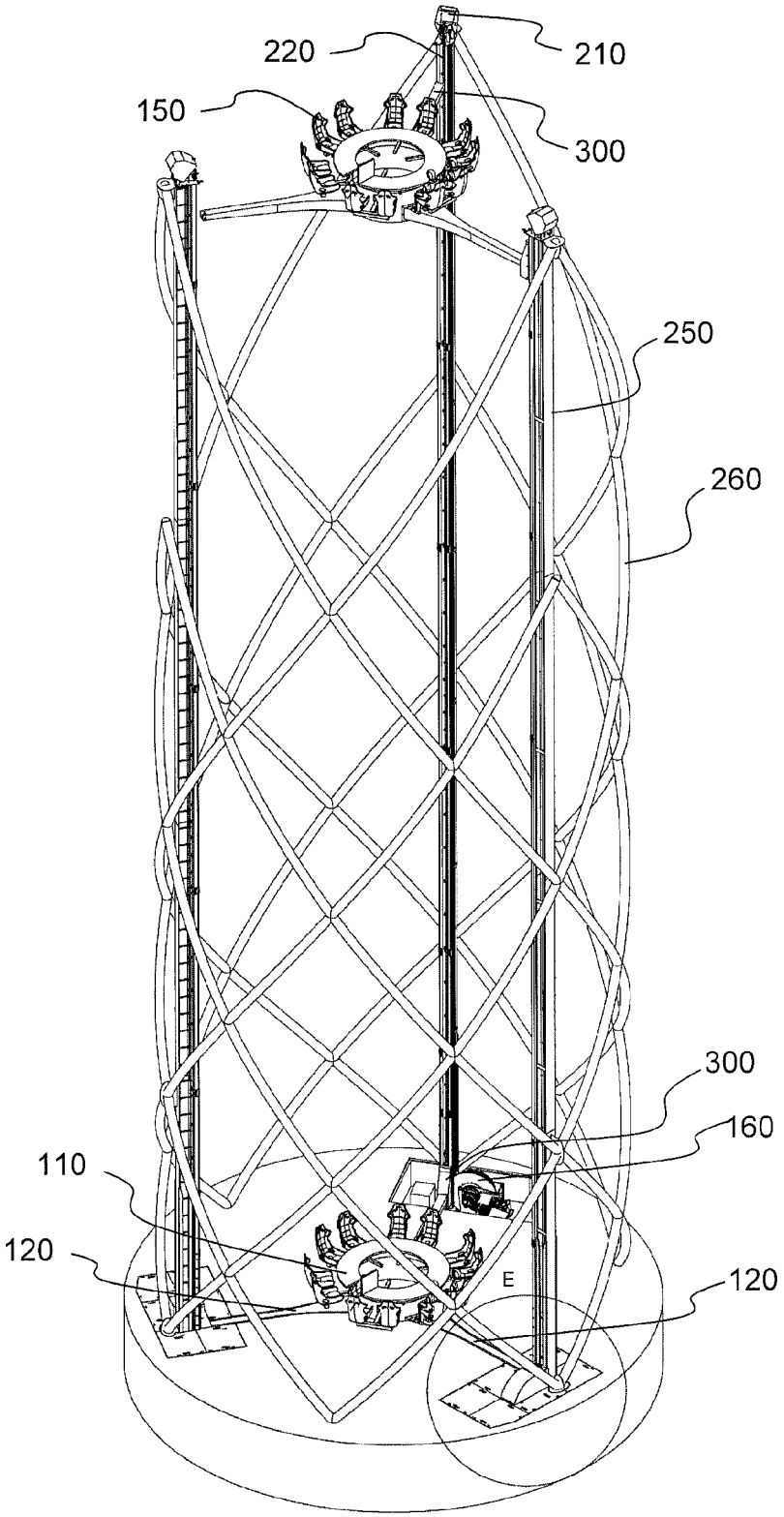
FIG. 2 is a perspective view of one particular embodiment of the assembly formed of the cylindrical structure and the mobile platform assembly.

FIGS. 1A and 1B show an assembly in accordance with one embodiment of the invention formed of a platform assembly 100 and a cylindrical structure or tower 200, respectively with the platform assembly on the ground and with the platform assembly raised. FIG. 2 shows in more detail one embodiment of the assembly shown in FIGS. 1A and 1B.

The tower 200 comprises a vertical structure with at least three posts 250 two of which can be seen in FIGS. 1A and 1B. The tower may also comprise walls between the vertical posts or braces connecting the vertical posts to stiffen the structure, for example braces 260 forming crossmembers or crossed helices, as shown in FIG. 2. The posts and the braces are metal tubes or structural sections, for example.

In accordance with the present invention, the platform assembly 100 intended to receive passengers is mobile within the tower 200. For example, it is driven up the tower by cables 220 of a drive system.

In the example of FIGS. 1A, 1B and 2, the tower is substantially cylindrical with a circular base and the circular platform assembly is provided with arms or beams enabling it to be spaced from the tower. This shape is not limiting on the invention, however, and the cylindrical structure forming the tower can have any section, for example hexagonal, triangular or square.

As shown in FIG. 2, the platform assembly 100 may comprise seats 150 for passengers. For example, the seats are arranged around a central platform 110 of the platform assembly, itself connected to the drive system by beams or arms 120. The seats may face toward the inside or the outside of the tower. In the former case, the passengers have the benefit or a more friendly arrangement; in the latter case, they have a direct view over the panorama. The seats may also pivot on themselves so that the passengers have the benefit of a 360° view. The platform assembly may also comprise a cover or roof 400 enabling protection of the passengers from inclement weather. The platform assembly being connected directly to the drive system rather than suspended, stability is significantly improved and a large number of passengers may be arranged around the central platform, even in an irregular manner. For example, the passengers are arranged within a circle that must have a diameter sufficient to accommodate all the passengers comfortably.

The tower may have a height between 30 m and 80 m in order to afford a good panoramic view when passengers are raised up on the platform assembly. Moreover, the platform assembly being connected directly to the drive system, it is possible for the passengers to have a completely unrestricted view in the raised position of the platform assembly (FIG. 1B), including of the structure itself.

For example, the posts 250 comprise guide rails in which the drive cables 220 are placed, for example cables of the type used for lifts. The guide rails are adapted to accommodate respective carriages 300 fastened to the ends of the beams 120 of the platform assembly. Each cable may extend from a winch 160 at the base of the tower to an idler pulley 210 at the top of the tower with a return run from the pulley 210 to the winch 160. The winch may be of the type used for lift installations; it may be associated with a control unit for controlling the direction of rotation of the cable 220 and regulate its speed; the control unit also synchronizes the movement of the three carriages so that the platform assembly rises in the tower level, i.e. keeping the central platform 110 horizontal.

Figure 3:
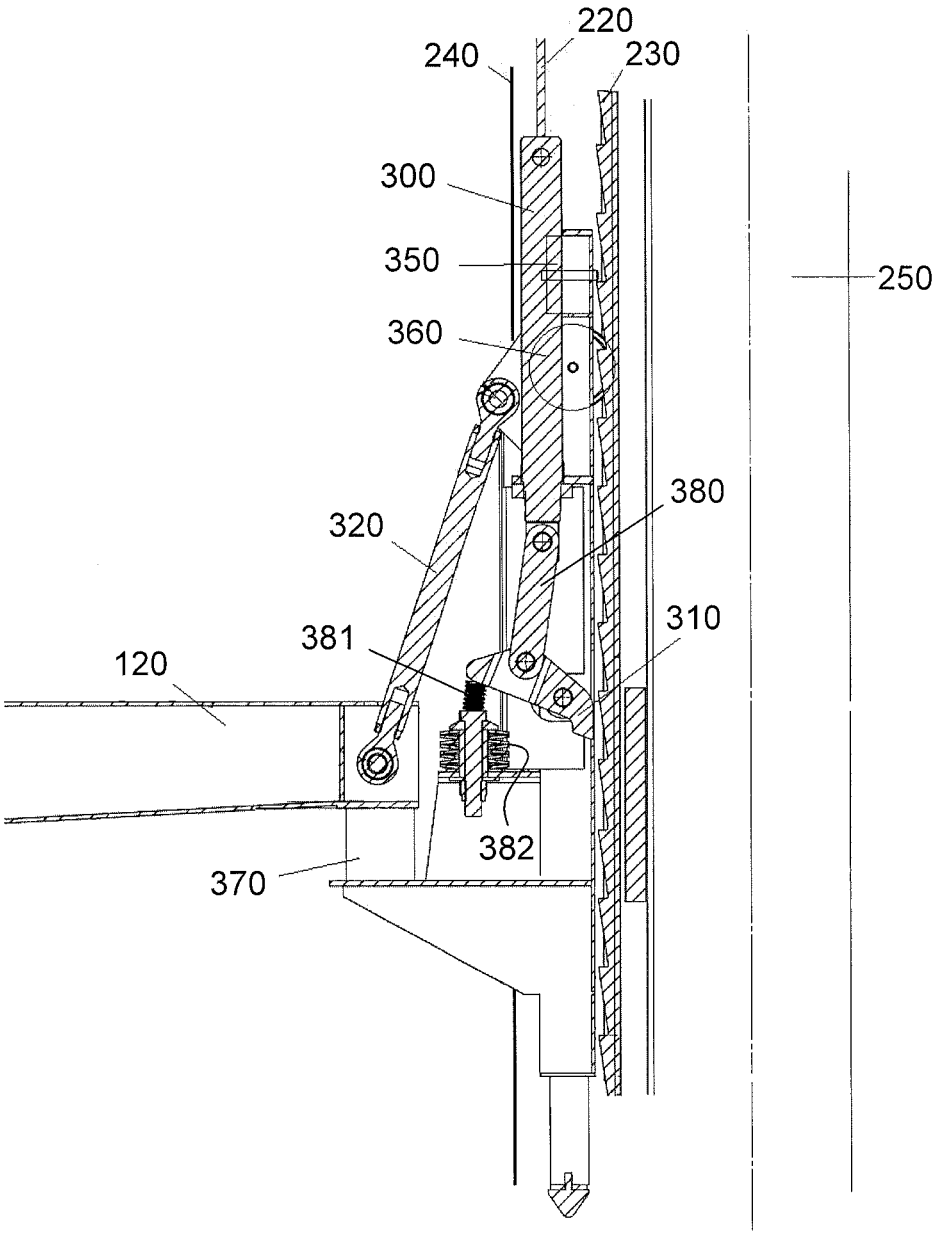
FIG. 3 is a detail view of the drive system of the mobile platform assembly from FIG. 2.

FIG. 3 shows a detail view of the platform assembly driving system in one embodiment. FIG. 3 shows a portion of a post 250 of the tower and a portion of a beam 120 connected to the central platform of the platform assembly. FIG. 3 also shows a carriage 300 accommodated in guide rails of the post 250 and attached to a drive cable 220. The cable 220 has two cable runs on either side of the idler pulley 210 (FIGS. 1A, 1B), a first cable run to which the carriage is attached defining a driving path and a second cable run defining a return path toward the winch 160 for winding in the cable. Each winch may be associated with a motor for driving movement of the cable in one direction or the other. For example, there may be three motors synchronized by an electronic unit to control the movement of the three cables to drive three carriages of the balloon along three posts of the tower. There may of course be more than three carriages and more than three motors if the tower has more than three vertical posts. There may equally well be a single motor driving movement of three cables.

FIG. 3 also shows a view in lateral section of a carriage 300 of substantially parallelepiped shape appropriate to a C-section (240) inside which it slides. The C-section is attached to a post 250 of the cylindrical supporting structure. The carriage is pulled by the cable 220. Lateral rollers 350, of which there are four, for example, bear on the right-hand and left-hand sides of the C-section. Transverse rollers 360 bear on the back of the C-section or on these returns. The arms or beams 120 of the platform assembly rest on the shoe of the carriage via a flexible damping member 370 of the Silentbloc® type that provides a flexible interface. A sling 320 suspends the arm from the carriage. Its length is adjustable to adjust the distribution of forces between the sling (tension) and the Silentbloc® (compression) and to optimize the behaviour of the platform assembly. Greater tension in the slings will be reflected in a greater freedom of movement of the platform assembly. Greater compression of the Silentbloc® will be reflected in more severe recentring of the platform assembly.

In order to increase the safety of the passengers, the use of a plurality of synchronized motors to drive the movement of a plurality of cables driving the carriages provides redundancy in the event of a breakdown or of a cable breaking. If a cable breaks, the carriage attached to that cable will slide along the post under its own weight, which will cause the platform assembly to tilt toward the post with the broken cable. This tilting, even if not dangerous to safety, may nevertheless frighten the passengers. A fall-preventing mechanism may therefore be provided on each carriage 300. In normal operation, the cable 220 takes the weight of the carriage and the platform assembly. The tension in the cable 220 drives vertical movement in translation of the link 380. The spring 381 is stretched and the finger 310 is retracted inside the carriage. If the cable 220 breaks, the tension in the cable disappears and the link is free to move in downward translation, being pulled by the spring 381 and causing the finger 310 to swing toward the exterior of the carriage. The carriage then falls freely until the projecting finger 310 strikes against a tooth of the rack 230 fixed to the back at the centre of the C-section. The spring 382 enables damping of the impact when the link strikes the rack and therefore stopping of the carriage and the platform assembly.

Figure 4:
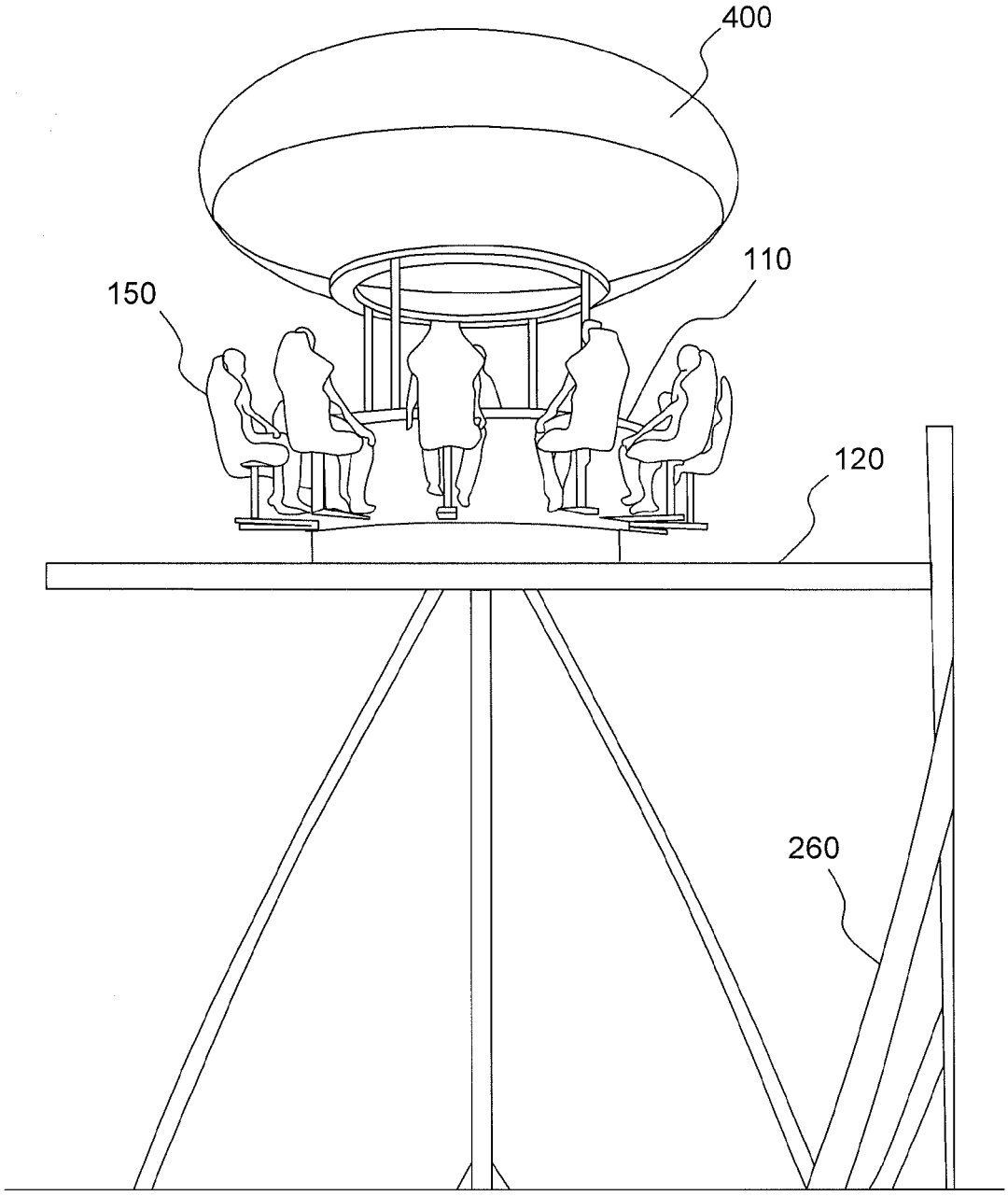
FIG. 4 is a perspective view of a platform assembly in one embodiment of the invention.

FIG. 4 shows one embodiment of a platform assembly comprising a central platform 110 connected to the cylindrical structure by beams 120. For example, the central platform is equipped with seats 150 for the passengers arranged around a structure forming a bar. The bar and the passengers are protected by a cover 400. The cover may be of any kind and may include an advertising sign, for example. It could be inflatable, for example. This inflatable cover could advantageously have an ellipsoidal shape, as shown in FIG. 4, in order to offer minimum wind resistance when the platform assembly is in the raised position and the cover extends beyond the upper edge of the tower.

Although described by way of a certain number of detailed embodiments, the assembly formed of the mobile platform assembly and the cylindrical structure in which the platform assembly is designed to be raised lends itself to different variants, modifications and improvements that will be obvious to the person skilled in the art, it being understood that these different variants, modifications and improvements fall within the scope of the invention as defined by the following claims.

The invention claimed is:

1. An assembly comprising:

a platform assembly intended to receive passengers, a cylindrical structure comprising at least three vertical posts, the platform assembly being mobile within the cylindrical structure, wherein the assembly further comprises at least three carriages fastened to the platform assembly and adapted to be attached to drive cables accommodated in guide rails of at least three of the posts of the cylindrical structure.

2. The assembly according to claim 1, further comprising, for each carriage, a fall-preventing mechanism comprising a finger fastened to the carriage and a rack fixed to the guide rail, the finger being intended to abut against a tooth of the rack in the event of loss of tension in the cable.

3. The assembly according to claim 1, wherein the platform assembly comprises a central platform and beams extending from the central platform, the carriages being fixed to the ends of the beams.

4. The assembly according to claim 1, further comprising a motor associated with each drive cable to drive the cable in one direction or the other.

5. The assembly according to claim 4, further comprising a control unit adapted to synchronize the cable drive motors.

6. The assembly according to claim 1, further comprising a cover for protecting passengers against inclement weather fixed above the platform assembly.

7. The assembly according to claim 6, wherein the cover is inflatable and of ellipsoidal shape.

* * * * *